United States Patent [19]

Dempsey

[11] Patent Number: 4,728,805

[45] Date of Patent: Mar. 1, 1988

[54] SYNAPTIC RADIO FREQUENCY INTERACTIVE SYSTEMS WITH PHOTORESPONSIVE SWITCHING

[75] Inventor: Richard C. Dempsey, Chatsworth, Calif.

[73] Assignee: California Microwave, Inc., Woodland Hills, Calif.

[21] Appl. No.: 929,404

[22] Filed: Nov. 10, 1986

[51] Int. Cl.[4] ..... H01J 40/14

[52] U.S. Cl. ..... 250/578; 342/374

[58] Field of Search ..... 342/374, 372, 368; 343/754, 700 MS; 250/551, 215, 227, 578

[56] References Cited

U.S. PATENT DOCUMENTS

| | | | |
|---|---|---|---|
| 4,028,702 | 6/1977 | Levine | 342/374 |
| 4,277,787 | 7/1981 | King | 342/374 |
| 4,329,580 | 5/1982 | Riley et al. | 250/215 |
| 4,367,474 | 1/1983 | Schaubert et al. | 343/700 MS |
| 4,387,378 | 6/1983 | Henderson | 342/374 |
| 4,451,831 | 5/1984 | Stangel et al. | 342/374 |
| 4,626,858 | 12/1986 | Copeland | 342/374 |

OTHER PUBLICATIONS

Article by J. R. Forrest and A. A. Salles, "Optics Control Microwaves," (MSN, Jun. 1961).

Photoconductive Cell Application Design Handbook, Clairex Electronics, published 1978 by Clairex Corporation.

RCA Electro Optics and Devices data sheet, published 9/81, for RCA's Solid State Detectors C30971E and C30971EL.

*Primary Examiner*—David C. Nelms
*Assistant Examiner*—Michael Messinger
*Attorney, Agent, or Firm*—Benoit Law Corporation

[57] ABSTRACT

Synaptic antennas or other radio frequency interactive systems variable in response to photon energy stimuli, are provided from a three-dimensional matrix of electrically conductive segments with photoresponsive devices selectively separating numerous adjacent segments from each other and alternatively interconnecting segments with each other in response to photon energy stimuli. Photon energy stimuli supplied to a first array of photoresponsive devices provide a first combination of interconnected segments constituting a first radio frequency interactive configuration in the matrix. Conversely, photon energy stimuli supplied to a second array of the photoresponsive devices provide a second combination of interconnected segments constituting a second radio frequency interactive configuration in the matrix. A third radio frequency interactive configuration in the matrix different from the first and second radio frequency interactive configurations may be provided by supplying photon energy stimuli to a third array of the photoresponsive devices, different from the first and second arrays, to provide a third combination of interconnected segments, and so forth.

33 Claims, 10 Drawing Figures

SYNAPTIC RADIO FREQUENCY INTERACTIVE SYSTEMS WITH PHOTORESPONSIVE SWITCHING

BACKGROUND OF THE INVENTION

1. Field of the Invention

The subject invention relates to radio frequency interactive systems, to electromagnetic antenna systems, to methods of making antennas or other radio frequency interactive systems, and, more particularly, to a transfer of the concept of synapsis to antenna or other radio frequency interactive systems and to the resulting synaptic antennas or other radio frequency interactive systems.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

Also, no preamble of any statement of invention or claim hereof is intended to represent that the content of that preamble is prior art, particularly where one or more recitations in a preamble serve the purpose or providing antecedents for the remainder of a statement of invention or claim.

The synaptic action of peripheral nervous systems is well known in anatomy. Briefly, in a synaptic nervous system, functional contacts is through synapses, as distinguished from nerve net. A synapse is defined as the locus at which the nervous impulse passes from the axon of one neuron to the dendrites of another having the form of an actual boundary between the two nerve fibers and providing a selective element.

Yet, despite such physical example of long standing, man has continued to make antenna systems in the conventional manner. This has in effect impeded antenna development, since a flexibility for rapidly changing antenna configurations, either for research, development and testing, or for operation in the field or elsewhere, was lacking.

Accordingly, man's development of antenna systems resembled more that of a nerve net as found in various lower invertebrates in the form of primitive nerve cells each of which appears continuous with adjacent cells without intervening synapses, with the resulting network conducting stimulation in all directions with a decrement.

An article by J. R. Forrest and A. A. Salles, entitled "Optics Control Microwaves," (MSN, June 1961) mentions direct control of microwave signals by optoelectronic effects.

Passive radio frequency modifiers have been provided by coating a surface with cadmium sulfide or cadmium selenide and by making use of photoconductive effects when light impinged upon such coating.

For information on photoconductive cells reference may, for instance, be had to the Photoconductive Cell Application Design Handbook, of Clairex Electronics, published 1978 by Clairex Corporation. For information on photodiodes, reference may, for instance, be had to the data sheet published November, 1981 by RCA for its Solid State Detectors C30971E and C30971EL.

SUMMARY OF THE INVENTION

It is a general object of this invention to overcome the disadvantages and meet the needs expressed or implicit in the above Information Disclosure Statement or in other parts hereof.

It is a germane object of this invention to provide improved antenna or other radio frequency interactive systems.

It is a related object of this invention to provide improved methods for developing, testing, making and operating antenna or other radio frequency interactive systems.

It is also an object of this invention to provide and operate such improvements without any interference with any radio frequency interactive function of any improved system according to the subject invention.

Other objects of this invention will become apparent in the further course of this disclosure, and no limitation to any object is intended by this brief summary.

From one aspect thereof, the subject invention resides in a method of making a radio frequency interactive system variable in response to photon energy stimuli, and, more specifically, resides in the improvement comprising in combination the steps of providing a three-dimensional matrix of electrically conductive segments with photoresponsive elements selectively separating numerous adjacent segments from each other and alternatively interconnecting segments with each other in response to photon energy stimuli, supplying photon energy stimuli to a first array of these photoresponsive elements to provide a first combination of interconnected segments constituting a first radio frequency interactive configuration in the matrix, and supplying photon energy stimuli to a second array of the photoresponsive elements to provide a second combination of interconnected segments constituting a second radio frequency interactive configuration in the matrix.

In practice, steps of the latter type may be repeated for like and for different radio frequency interactive configurations. For instance, photon energy stimuli may be supplied to a third array of the photoresponsive elements, different from the first and second arrays, to provide a third combination of interconnected segments constituting a third radio frequency interactive configuration in the matrix different from the first and second radio frequency configurations.

From a related aspect thereof, the subject invention resides in a radio frequency interactive system variable in response to photon energy stimuli, and, more specifically, resides in the improvement comprising, in combination, a three-dimensional matrix of electrically conductive segments and means including photoresponsive elements for selectively separating numerous adjacent segments from each other and for alternatively interconnecting segments with each other in response to photon energy stimuli, and including means for supplying photon energy stimuli to a first array of the photoresponsive elements to provide that first combination of interconnected segments constituting a first radio frequency interactive configuration in the matrix, and for alternatively supplying photon energy stimuli to a second array of the photoresponsive elements to provide the second combination of interconnected segments constituting a second radio frequency interactive configuration in the matrix.

The subject invention is not limited to three-dimensional matrices.

Also, other aspects of the invention become apparent in the further course of this disclosure and no restriction whatever is intended by this Summary of the Invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
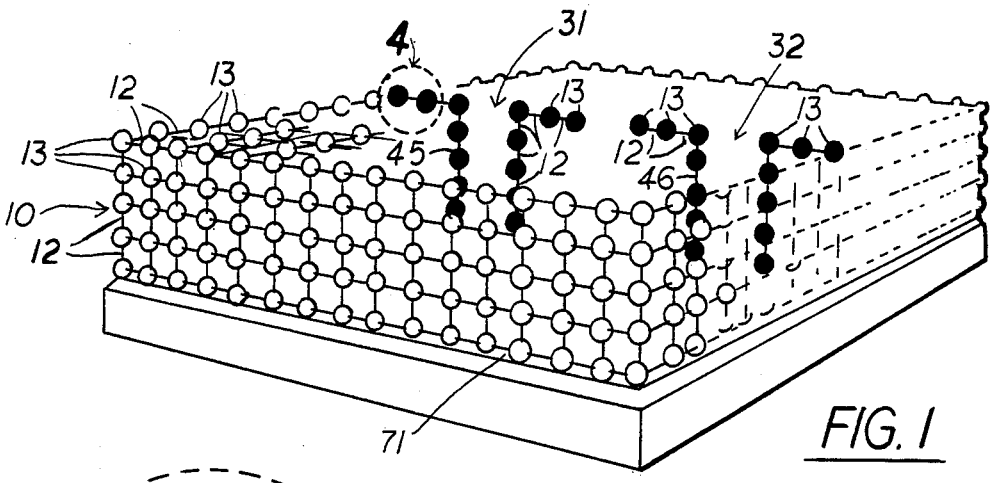
FIG. 1 is a perspective view of a radio frequency interactive system according to a preferred embodiment of the subject invention.

FIGS. 1 et seq. show antenna systems 10, etc., variable in response to photon energy stimuli.

These antenna systems comprise an at least two-dimensional matrix of antenna elements or segments 12. By way of example, these segments may be wires, rods, tubes or the like, which are metallic, metallized or otherwise rendered electrically conductive for radio frequency emission or reception purposes. For instance, metals and stock that has so far been used for antenna purposes may be employed for providing the segments. Where low weight is a factor, plastic rods, tubes or fibers with electrically conductive coatings may be employed for making the antenna elements 12.

Photoresponsive devices 13 are connected to the antenna elements for selectively separating numerous adjacent antenna elements 12 from each other and for alternatively interconnecting antenna elements with each other in response to photon energy stimuli.

For two-dimensional arrays, photoresponsive elements 13 may be located in corners of squares of the antenna element matrix, while antenna elements 12 extend along the sides of such squares. For three-dimensional matrices, photoresponsive devices 13 may be located in corners of cubic constituents of such matrices, while antenna elements 12 extend along sides of such cubic unit cells, as shown, for instance, in FIGS. 1 to 3.

A typical photoresponsive element 13 should have four outputs for a two-dimensional array. Of course, along the sides of such an array, three outputs would do, while one could manage with only two outputs in outer corners of two-dimensional arrays.

While two-dimensional antenna matrices are within the scope of the subject invention, the ultimate utility of the subject invention is seen in three-dimensional matrices of antenna segments or interactive configurations.

For the preferred three-dimensional matrices, six switching elements are necessary for each photoresponsive device 13, except for outer matrix corners and sides.

In order to avoid overcrowding of the drawings and obscuration of key features, not every antenna element 12 and photoresponsive device 13 has been shown in the drawings. However, it should be understood that the antenna elements 12 generally run along cubic unit cells, while photoresponsive devices 13 are located in corners of such cubic unit cells, of the three-dimensional matrices shown in FIGS. 1 to 3, for instance.

Figure 4:
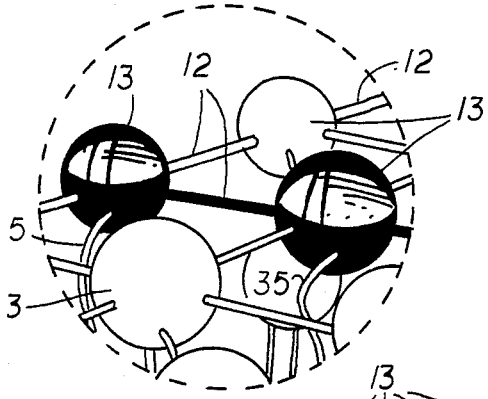
FIG. 4 is a detail view of a portion of FIG. 1 within the phantom circle 4.

FIG. 4 shows a detail of FIG. 1, on an enlarged scale, rendering antenna elements 12 and photoresponsive devices 13 and their mutual relationship better visible.

Figure 5:
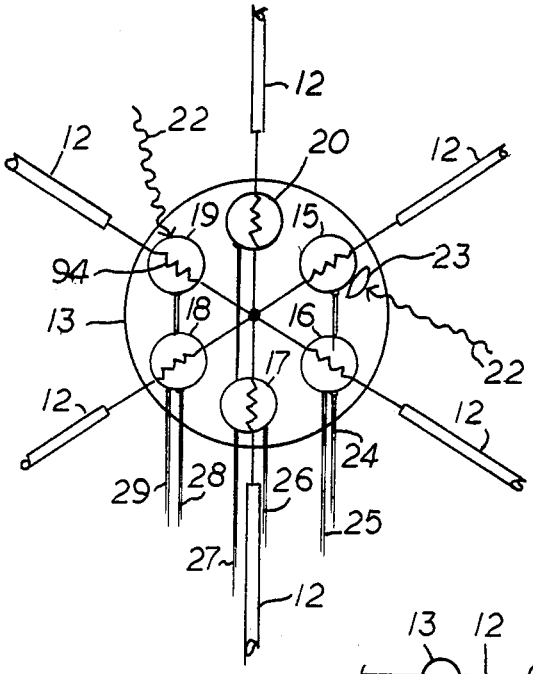
FIG. 5 is a diagramatic view of a synaptic device usable according to an embodiment of the subject invention in FIG. 1 and in the other systems herein disclosed.

FIG. 5 shows somewhat diagramatically a photoresponsive device 13 for the preferred three-dimensional matrix according to the subject invention. For that purpose, the photoresponsive device 13 includes six photoresponsive elements 15, 16, 17, 18, 19 and 20. FIG. 5 diagramatically illustrates photoresistive elements 15 to 20, but it should be understood that photodiode junctions and other photoresponsive elements may be employed in addition or instead within the scope of the subject invention.

As illustrated for the element 19 in FIG. 5, photon energy stimuli 22 may be supplied to the photoresponsive devices by direct radiation. As shown for the element 15 in FIG. 5, a lens 23 or other photoamplifier means may be employed, if the direct radiation 22 would not be sufficient to switch a particular photoresponsive element.

While such direct radiation, with or without intensification or amplification, is within its scope, the subject invention presently prefers supplying the requisite photon energy stimuli to the elements 15 to 20 by optical fibers 24, 25, 26, 27, 28 and 29. Fiber optics and its techniques may be employed for that purpose.

In viewing FIG. 5, it can be realized that adjacent horizontal and vertical antenna elements 12 can be interconnected in all kind of combinations by appropriate energization of elements 15 to 20 via optical fibers 24 to 29.

For instance, photon energy stimuli may be supplied to a first array of photoresponsive devices 13 to provide a first combination of interconnected antenna elements constituting a first antenna figuration in the matrix. Conversely, photon energy stimuli may be supplied to a second array of photoresponsive devices 13 to provide a second combination of interconnected antenna elements 12 constituting a second antenna configuration in the matrix. Similarly, photon energy stimuli may be supplied to a third array of photoresponsive devices 13, different from the first and second arrays, to provide a third combination of interconnected antenna elements constituting a third antenna configuration in the matrix different from the first and second antenna configurations. In principle, several different antenna configurations could be provided in this manner either subsequently or even simultaneously.

In this respect, FIG. 1 shows two dipole antennas 31 and 32 produced simultaneously in the same antenna element matrix, by a corresponding emission of photon energy stimuli to elements of the photoresponsive devices 13 shown in black in FIGS. 1 and 4.

Within the scope of the subject invention, the interconnected antenna elements 12 could be formed in a two-dimensional array rather than in a spatial configuration. However, FIG. 1 shows also the formation of feeder lines by interconnection of vertical antenna elements 12 via appropriately stimulated photoresponsive devices.

According to FIG. 5, such appropriate stimulation is effected via individual optical fibers 24, etc. In practice, these fibers may be formed into bundles, such as the fiber optic bundles 35 shown in FIG. 4.

Accordingly, the photoresponsive devices 13 are individually equipped with fiber optic lines for supplying photon energy stimuli to such photoresponsive devices. Such fiber optic lines or bundles may include several optical fibers, such as the six optical fibers 24 to 29 shown for the photoresponsive elements 15 to 20 of the photoresponsive device 13 of FIG. 5.

The fiber optic lines or optical fibers may extend along antenna elements 12, as apparent from the lines 35 in FIG. 4, or for the optic fibers 26 and 27 in FIG. 5.

Figure 2:
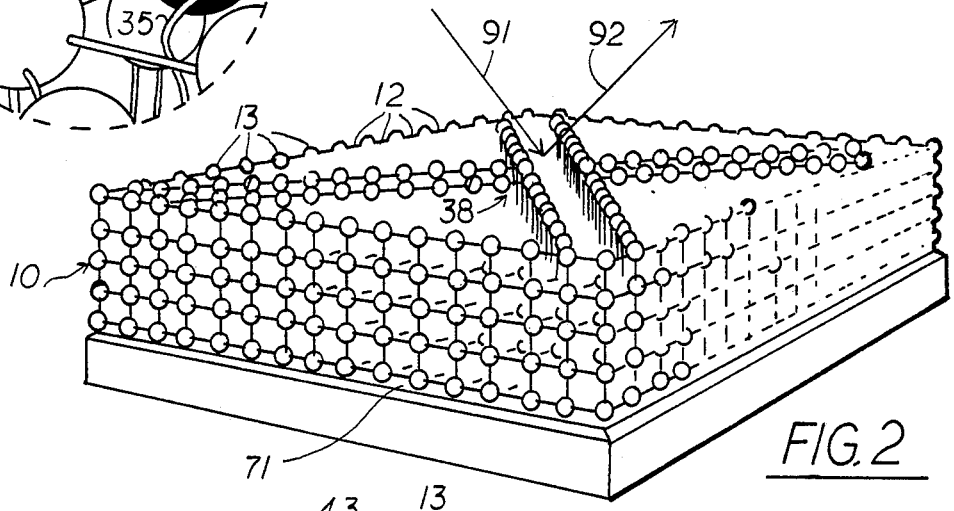
FIG. 2 is a view similar to FIG. 1, showing formation of a particular antenna and also modification of an electromagnetic wave, according to an embodiment of the subject invention.

FIG. 2 shows a crossed bowtie antenna 38 as an example of a further antenna configuration that can be realized by appropriate selective photon stimulation of photoresponsive elements and devices 13. Except for antenna elements 12 extending along the sides of the matrix, and photoresponsive devices 13 located on such sides, only antenna elements and photoresponsive devices which participate in the formation of the bowtie antenna 38 have been shown in FIG. 2. The same applies, in so many words, to the further antenna configuration 39 shown in FIG. 3.

Figure 3:
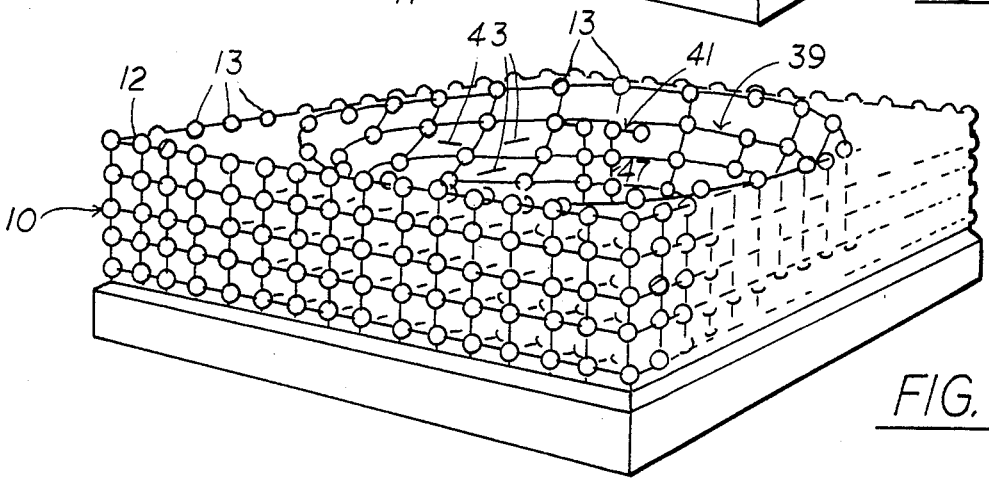
FIG. 3 is a view similar to FIG. 1, showing formation of a parabolic reflector antenna according to a further embodiment of the invention.

In particular, FIG. 3 shows a parabolic reflector 39 formed by selective energization of photoresponsive elements in several horizontal planes. To illustrate the resulting antenna configuration within the three-dimensional matrix, the antenna elements participating in the representation of the parabolic outline have been shown in a curved manner. However, it should be understood that in practice the participating antenna elements would be as straight as the remaining antenna elements 12, and that as many photoresponsive junctions 13 are employed as necessary, so as to provide a reflector of satisfactory parabolic shape.

FIG. 3 also shows a dipole antenna 41 within the parabolic reflector, formed by further selective energization of photoresponsive devices according to the principles of the subject invention. The dipole 41 may act as a feeder of radio frequency energy to the parabolic reflector, or may pick up radio frequency energy received by that parabolic reflector or antenna.

In practice, there are antenna elements 43 within the confines of the parabolic antenna 39 that do not participate in the formation of that reflector and of the central dipole 41. These antenna elements are not interconnected by any photoresponsive devices and are, therefore, passive in that sense. However, they may have some influence on the gain or other performance of the parabolic antenna. In most practical applications, such influence is compensated by higher amplification or in other appropriate ways. Any extra effort of that kind is well outweighed by the great advantage of flexibility of antenna formation and reconfiguration according to the subject invention.

The passive antenna elements or segments 43, only two of which are shown in FIG. 3, preferably are as short as feasible, to avoid undue interference thereby. For instance, these passive elements 43 preferably are shorter than a wavelength, or even than a quarter wavelength, of the radio frequency signal being transmitted or received by the antenna configuration or antenna configurations formed in the matrix 10.

Moreover, the shorter the segments 12, the more ideal approximation of the reflector 39 to a parabolic shape.

In general terms, the elements or segments 12 should be as short as possible for minimum interference of passive elements or segments 12 with any antenna or other radio frequency interactive configuration, and for maximum approximation of any antenna or other radio frequency interactive configuration 31, 32, 38, 39, 41, etc., formed or to be formed in the matrix 10 of such conductive segments 12 and intervening photoresponsive devices 13 or elements 15, 16, etc.

As shown in the drawings, including FIGS. 1 to 3, photoresponsive elements are stimulated differently in different levels of the three-dimensional matrix 10. One graphic example of this principle is the formation of the parabolic reflector 39 according to FIG. 3, but other curved, tilted or otherwise situated configurations may be formed as well within the scope of the subject invention.

As shown in FIGS. 1 to 3, selected ones of the photoresponsive elements 13, etc., may be used to form with segments 12 connected thereto radio frequency feed lines 45 to 47 through the three-dimensional matrix 10 and to at least one of the radio frequency interactive configurations or antennas 31, 32, 41, etc. The particular configuration of segments 12 is then operated as a radio frequency antenna, as more fully disclosed below.

Apart from or within any formed antenna configuration, part of the segments, such as those shown at 43 in FIG. 3, may be used as parasitic elements for that antenna. Photoresponsive elements 13 etc., connected to such segments 43 may be optically stimulated to form such elements into parasitic loops for any formed antenna configuration.

Figure 6:
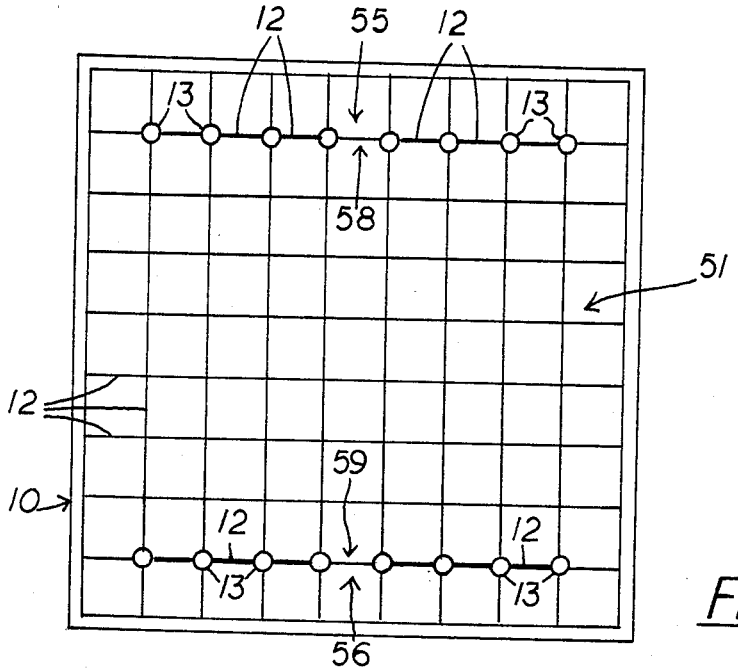
FIGS. 6 and 7 are top and side views, respectively, of a synaptic matrix.
Figure 7:
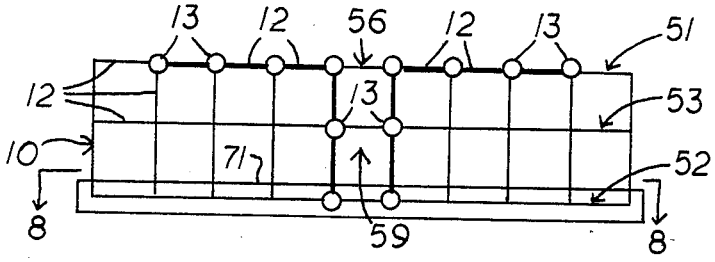
Figure 8:
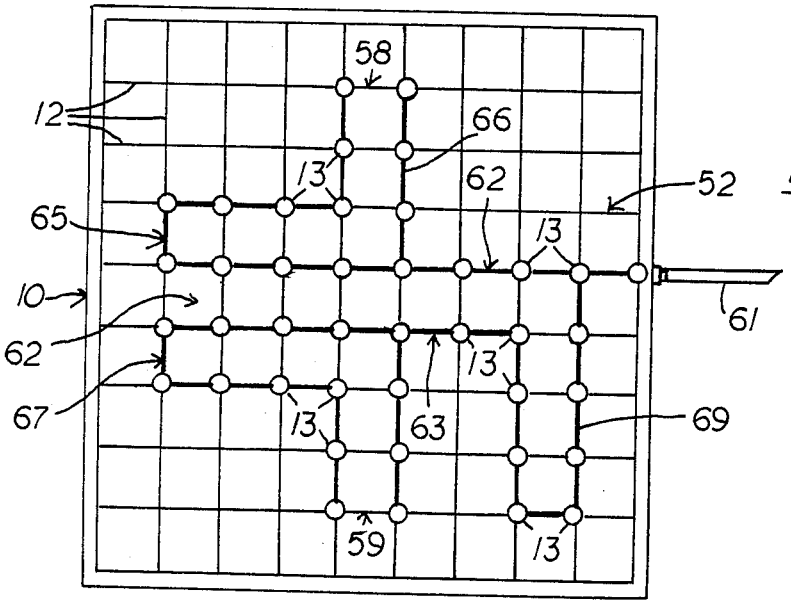
FIG. 8 is a top view of a lower level of that matrix taken, essentially, on the line 8—8 in FIG. 7.

FIG. 6 shows a top level 51 and FIG. 8 a lower level 52 of the matrix 10, while FIG. 7 also shows an intermediate level 53 of that multi-layered matrix. For increased clarity, only photoresponsive devices 13 connected to segments being part of a formed radio frequency interactive configuration are shown in these drawings, and such participating segments 12 are again shown by bold lines.

FIGS. 6 to 8 show the formation of two dipole antennas 55 and 56 as a further example of an antenna configuration achievable with the matrix 10. In FIG. 7, only three levels of that matrix are shown. While this is within the scope of the subject invention, more levels may, of course, be provided within a three-dimensional matrix.

Photoresponsive elements in devices 13 extending in vertical arrays are used to provide vertical feedlines for the dipole antennas 55 and 56. Only the top and the bottom of the feedline 58 of the antenna 55 is seen in FIGS. 6 and 8. On the other hand, FIG. 7 also shows a side view of a feedline 59 for the antenna 56.

FIG. 8 shows an example of a beamforming network configured pursuant to principles of the subject invention for the antennas 55 and 56. A coaxial cable 61 may be employed for feeding the radio frequency energy to the beamforming network 62 in the case of transmitting antennas, and for deriving received radio frequency energy from the beamforming network in the case of receiving antennas.

Photoresponsive elements in the synaptic devices 13 are employed to interconnect adjacent segments 12 into a feeder 62 for the antenna 55. Similarly, different photoresponsive elements in synaptic devices 13 are stimulated to form from other segments 12 a feeder 63 for the second antenna 56.

Each of these feeders is configured to provide a balun for the antenna connected thereto. For instance, in the case of receiving antennas, the feeders 62 and 63 match the balanced condition of each antenna to the unbalanced coaxial cable 61; with balanced/unbalanced being briefly referred to as "balun." Conversely, in the case of transmitting antennas, the feeders 62 and 63 match the unbalanced condition of the coaxial cable 61 to the balanced dipole antennas 55 and 56, with the expression "balun" being also employed for that kind of radio frequency transformation or transformer.

For the balun effect desired for the antenna 55, photoresponsive elements in synaptic devices 13 are employed to interconnect segments 12 into a loop 65 which delays the phase of the radio frequency by 180° relative to the phase supplied along the straight line 66 to or from the antenna 55.

Similarly, photoresponsive elements in further synaptic devices 13 are employed to form other segments 12 into a second loop 67 for providing the phase shifting requisite for the desired balun effect with respect to the second antenna 56. This is operative in practice and can be subjected to variation as to loop formation, balun effect, and in any other manner by rearrangement of the optical stimulation of various elements of the several synaptic devices 13.

By way of further example, FIG. 8 shows formation of a further loop 69 in the feeder 63 of the second antenna 56; again by selective optical stimulation of photoresponsive elements in yet other synaptic devices 13. By way of example, the third loop 69 is shown as imposing another phase delay of 180° in the second antenna feeder 63 relative to the first antenna feeder 62. However, it should be understood that such phase shift is variable by varying stimulation of different photoresponsive elements in synaptic devices 13 within the scope of the subject invention.

Accordingly, the disclosure of FIG. 8 may be seen as an example of constituting the first radio frequency interactive configuration into a first balun, including feeder 62 and loop 65, for a first antenna 55, and constituting the second radio frequency interactive configuration into a second balun, including the feeder 63 and loops 67 and 69, for a second antenna 56, all by appropriate photon energy stimulation of photoresponsive elements within synaptic devices 13.

As already indicated above, the second balun, for instance, may be varied relative to the first balun by photon energy stimulation of selected photoresponsive elements between adjacent segments 13. In practice this may, for instance, be employed for beamforming purposes.

Within the scope of the subject invention, the antenna feed network shown in FIG. 8 may be connected to invariable or fixed antennas which may be of a conventional type. However, FIGS. 6 and 7 show an extension of that principle by illustrating the formation of balanced feed lines 58 and 59 and even of antenna configurations 55 and 56 by the photoresponsive synaptic techniques according to the subject invention.

In this respect, the synaptic network disclosed with the aid of FIG. 8 may be employed by itself. On the other hand, FIGS. 1 to 7 show how the matrix may be provided with further photoresponsive elements between further electrically conductive segments 12, and how photon energy stimuli may be supplied to selected ones of such further photoresponsive elements in synaptic devices 13, to constitute first and second antennas 31, 32, 38, 39, 41 or 55 and 56 from adjacent ones of the further electrically conductive segments 12, and how such antennas may be connected to the feed networks or baluns, such as by forming feedlines 45, 46, 47 or 58 and 59 between the baluns and antennas by photon energy stimulation of more of the photoresponsive elements, such as those located in synaptic devices 13 at intermediate levels of the matrix 10.

The matrix may be provided with a ground plane 71 for the antennas 31, 32, 38 or 55 and 56 or for the other radio frequency interactive configurations.

A preferred embodiment of the subject invention provides different illumination patterns for the photoresponsive elements to provide selectively the illustrated and other different antennas or radio frequency interactive configurations from various matrices and arrays.

Figure 9:
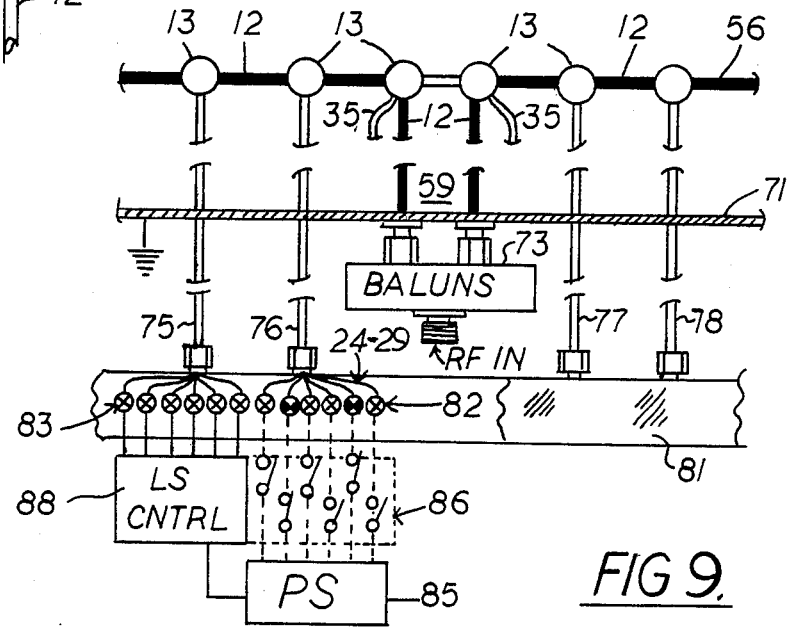
FIG. 9 is a detail of a side view similar to FIG. 7, but modified to emphasize optic stimulation of synaptic junctions according to a further embodiment of the subject invention.

This is illustrated herein with the aid of FIG. 9 which shows a detailed view on an enlarged scale, similar to the view of FIG. 7. However, to avoid overcrowding, FIG. 9 shows only few of the photoresponsive devices 13 and segments 12 with which the dipole antenna 56 is synaptically formed. Also, FIG. 9 shows a balun 73, with the understanding that the balun shown in FIG. 8 could be provided instead.

According to FIG. 9, fiber optic lines or bundles 75, 76, 77 and 78 extend from synaptic devices 13 through the ground plane to a photon energy stimuli generator 81. Each fiber optic bundle may include as many optical fibers as necessary for stimulating the different photoresponsive elements 15 to 20 in each synaptic device 13 individually. The stimuli generator 81 includes banks of light-emitting diodes, laser diodes or other suitable light sources 82, 83, etc. Typically, each synaptic device 13 is provided with its own bank. The light souces in each bank correspond in number to the fibers 24 to 29 necessary for individually stimulating the photoresponsive devices 15 to 20. Within the scope of the subject invention, less light sources than photoresponsive elements could be provided, but light modulators, controllable light guides or shutters would then be necessary to provide individual stimulation from less light sources or through less optical fibers than the number of photoresponsive elements.

The light sources in banks 82, etc. may be viewed as devices or elements for transducing electrical control signals into corresponding luminous or photon energy signals or stimuli and for inputting the same into the optical fibers 24, etc.

In the example shown in FIG. 9, an electrical power source 85 provides energy for the electic control signals. A bank of switches 86 is shown as connected between that power source and the bank of light sources 82 for individually switching those light sources on and off to provide illumination patterns for the photoresponsive elements 15 to 20 so as to realize an interconnection of segments for the realization of a desired antenna or other radio frequency interactive configuration.

By way of example, in order to interconnect two of the segments 12 connected to the synaptic device 13 to which the fiber optic bundle 76 is coupled, it is necessary to close or activate two of the switches in the bank 86. Accordingly, two of such switches are shown closed, while the other switches in the bank 86 are shown open. The segments 12 which are interconnected in this manner by the synaptic device coupled to the fiber bundle 76 are shown in bold lines in FIG. 9, together with the other segments forming a central part of the antenna 56 and of its vertical feeder 59 leading through the ground plane 71 to the balun 73, as in the case of the embodiment shown in FIG. 7 with respect to the baluns shown in FIG. 8 at the lower matrix level 52.

In practice, the switches typically will be electronic, and FIG. 9 shows control apparatus 88 for controlling the bank of light sources 83 for the synaptic device 13 coupled to the fiber bundle 75. Microprocessors and other computer technology will typically be employed to provide the different illumination patterns for the photoresponsive elements 15, 16, 17 etc., in the different synaptic devices 13 for a realization of all desired antenna or other radio frequency interactive configurations in matrices of the type herein disclosed.

What has been shown in FIG. 9 for two of the fiber bundles 75 and 76, is also provided for the other fiber bundles of the three-dimensional matrix 10. To avoid overcrowding of the figure, only parts of the fiber bundles 35 have been shown in FIG. 9 for the synaptic devices 13 closest to the center of the antenna configuration 56. However, it will be noted that the segment 12 between those central devices 13 is blank, indicating that a dipole antenna is formed by not interconnecting a central segment with adjacent ones of the segments 12. Of course, a series of segments 12 could be left unconnected, depending on the desired configuration of the antenna or other radio frequency interactive structure.

On the other hand, vertical and horizontal segments 12 leading into and out of the central synaptic devices 13 are shown in black, indicating that two selected photoresponsive elements are stimulated in each central synaptic device to provide the antenna feeder line 59 and adjacent portions of the dipole antenna configuration 56. By way of example, the photoresponsive elements 17 and 18 could be stimulated via fibers 26 and 28 in the synaptic device 13 immediately to the left of the center of the dipole antenna 56, while photoresponsive elements 15 and 17 are stimulated via fibers 24 and 26 in the synaptic device 13 immediately to the right of that center. In this example, the remaining photoresponsive elements in the particular central synaptic devices would not be stimulated, so that the remaining segments 12 at such synaptic devices would remain disconnected, as shown for the central segment 12 in FIG. 9.

In the description of the drawings, the formation of various active antenna configurations has been emphasized. However, the utility of the subject invention is not so limited but extends to other active, as well as passive, radio frequency interactive configurations, such as microwave lenses and passive radio frequency modifiers. In order to avoid a proliferation of drawings, this principle will be illustrated with the aid of FIG. 2, with the understanding that the formation of any bowtie configuration 38 is at best coincidental when microwave lenses or radio frequency modifiers are formed and operated.

For the purpose of disclosing a passive radio frequency modifier according to an embodiment of the subject invention, an arrow in FIG. 2 shows an incoming or incident radio frequency wave 91, while another arrow shows the radio frequency wave 92 resulting from a reflection of the wave 91 by the appropriately stimulated matrix 10.

By way of example, when all photoresponsive elements 15 to 20 in all synaptic devices 13 are stimulated, all horizontal and vertical segments 12 in the entire matrix 10 are interconnected with each other, thereby presenting a fine grid to the incoming wave 91, which may practically present the equivalent of a solid reflective surface, if all elements 12 are much shorter than the wavelength of the incoming wave 91.

According to a further embodiment of the subject invention, the characteristics of the reflected wave 92, including phase and amplitude, may be modified by variation of the coarseness of the grid presented by interconnected segments 12. The grid coarseness presented to the incoming wave 91 may be made different at different levels of the matrix 10.

For instance, all photoresponsive elements 15 to 20 in every synaptic device 13 could be stimulated for a provision of the finest grid at the bottom level of the matrix. At the next higher level, only photoresponsive elements in every other synaptic device could be stimulated for the provision of a coarser grid. This principle could be expanded by energizing photoresponsive elements in only every third synaptic device in the next higher level, in only every fourth synaptic device in the still next higher level, and in only every fifth synaptic device in the top level of the matrix 10 shown in FIG. 2, whereby the incoming wave 91 will be subjected to a reflective grid of diminishing coarseness as it penetrates through the matrix, to encounter the reflective ground plane 71, if any.

In practice, the ground plane 71 may be omitted, such as in the case of a utilization of the matrix as a microwave lens.

The matrices according to the subject invention need not be flat, but may be curved or cornered in every manner.

Matrices according to the invention have an inherent failsafe feature in that all segments will automatically become disjointed in case of power failure.

By providing photon energy stimulation for selective segment interconnection and switching, the subject invention enables the use of a large number of segment switching locations and a short length of segments, without interference with radio frequency waves to be emitted, received, reflected or modified by the matrices according to the subject invention, since the photon energy stimuli and the optical fibers or other means for guiding them have no adverse effect on radio frequency energy.

The optical fibers may extend through or along the segments 12, as desired and practical for various purposes, without interfering with the radio frequency interactive function of various interconnected segment configurations.

As already indicated at 22 and 23 in FIG. 5, exposure or switching of photoresponsive elements may be by direct irradiation with photon energy. Fibers 24, 25, etc. may be omitted in that case.

The latter variant within the scope of the subject invention is of particular significance in the case of passive radio frequency modifiers. By way of example, if it is important that a radio frequency reflector behave differently during the day than at night, photoresponsive devices, if necessary equipped with optical lenses 23, could be provided throughout the matrix to achieve that purpose. Antennas could be made larger and smaller according to principles of the subject invention, as the sun rises or goes down, or as any significant illumination changes in any other manner. This would, for instance, be of utility, where regulations or technological necessity allows for one antenna size during the day, and another, possibly smaller, antenna size during the night, in order to avoid interference with other transmissions, for instance.

Another feature according to the invention is equally if not even more useful in practice; namely, the provision of lumped loading in the matrix by providing and operating selected photoresponsive devices 13, 15, 16 etc., between adjacent segments 12 as radio frequency resistors 94. This will now be explained with the aid of FIG. 10, which shows a curve 96 representing the resistance, R, of a photoresponsive element or photoconductive cell 94 as a funtion of illumination or photon energy stimulization, S. The resistance, R, may be in ohms or multiples thereof, and the photon energy stimulization, S, in foot candles, or in any other recognized unit of illumination.

When the intensity of illumination of a photoconductive cell 94 is high, its resistance is correspondingly low, such as shown at H and $R_L$. This is expected to represent the situation in the formation of typical antenna and radio frequency modifier configurations.

However, lumped loading may be provided even in those cases within the scope of the subject invention.

Figure 10:
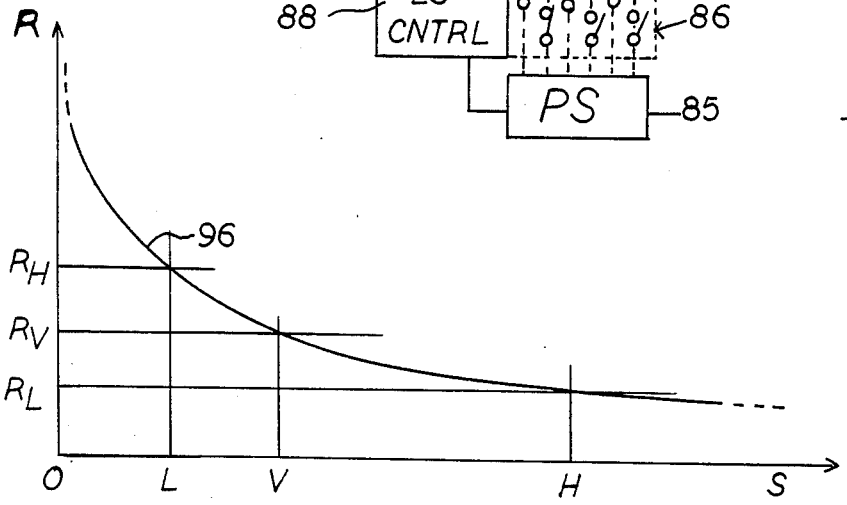
FIG. 10 is a graph showing resistance values versus intensity of illumination of synaptic junctions.

As seen in FIG. 10, if the illumination intensity is low, as shown at L, the resistance of the photoconductive cell is much higher, as illustrated at $R_H$. The resistance of the photoconductive cell 94 may be varied, as indicated at V and $R_V$ in FIG. 10, until a desired resistance for a given lumped loading is achieved.

By stimulating different photoresponsive elements 15 to 20 in different synaptic devices 13 not only differently but at different light or photon energy intensities, all kind of lumped antenna or other radio frequency interactive configurations can be provided in the matrices of the subject invention.

This principle may be expanded by synaptically switching capacitive, inductive or other reactive elements or combinations with photon energy stimuli with respect to segments 12.

Variable light sources or electronically controlled light modulators are available for providing variable and controlled light intensities for photoconductive cells.

As apparent from the initially cited literature, and as known in general, photoconductive cells are old as such. Of course, the practice of the subject invention may extend to whatever new photoconductive cells come to be known or are devleoped.

Photodiodes, phototransistors, and other photoresponsive devices may be employed in the practice of the subject invention, as long as any need for an electrical bias does not interfere with the operation or performance of the desired antenna or radio frequency interactive configurations.

By way of example, photoconductive cell configurations employing cadmium sulfide, cadmium selenide, gellium arsenide or silicon, are usable in the practice of the subject invention.

The subject extensive disclosure will render apparent or suggest to those skilled in the art various modifications and variations within the spirit and scope of the subject invention and equivalents thereof.

I claim:

1. In a method of making a radio frequency interactive system variable in response to photon energy stimuli, the improvement comprising in combination the steps of:

providing a matrix of electrically conductive segments with photoresponsive elements selectively separating numerous adjacent segments from each other and alternatively interconnecting segments with each other in response to photon energy stimuli;

supplying photon energy stimuli to a first array of said photoresponsive elements to provide a first combination of interconnected segments constituting a first radio frequency interactive configuration in said matrix; and supplying photon energy stimuli to a second array of said photoresponsive elements to provide a second combination of interconnected segments constituting a second radio frequency interactive configuration in said matrix.

2. A method as claimed in claim 1, including the step of:

supplying photon energy stimuli to a third array of said photoresponsive elements, different from said first and second arrays, to provide a third combination of interconnected segments constituting a third radio frequency interactive configuration in said matrix different from said first and second radio frequency interactive configurations.

3. A method as claimed in claim 1, wherein:

said photon energy stimuli are supplied to said photoresponsive elements by direct radiation.

4. A method as claimed in claim 1, wherein:

said photoresponsive devices are individually equipped with fiber optic lines for supplying photon energy stimuli to said photoresponsive elements.

5. A method as claimed in claim 4, wherein:

parts of said fiber optic lines are extended along said segments.

6. A method as claimed in claim 1, including the step of:

providing lumped loading in said matrix by providing and operating selected photoresponsive devices between adjacent segments as radio frequency resistors.

7. A method as claimed in claim 1, wherein:

said matrix is made at least two-dimensional.

8. A method as claimed in claim 7, including the step of:

providing said matrix with a ground plane for said radio frequency interactive configurations.

9. A method as claimed in claim 1, wherein:
said matrix is made three-dimensional.

10. A method as claimed in claim 9, including the steps of:
stimulating photoresponsive elements in different levels of said three-dimensional matrix differently for different radio frequency interactive effects.

11. A method as claimed in claim 9, including the steps of:
using selected ones of said photoresponsive elements to form with segments connected thereto radio frequency feedlines through said three-dimensional matrix and to at least one of said radio frequency interactive configurations; and
operating said at least one configuration as a radio frequency antenna.

12. A method as claimed in claim 9, including the steps of:
operating at least one of said radio frequency interactive configurations as a radio frequency antenna; and
using part of said segments as parasitic elements for said antenna.

13. A method as claimed in claim 1, including the steps of:
constituting said first radio frequency interactive configuration into a first balun for a first antenna; and
constituting said second radio frequency interactive configuration into a second balun for a second antenna.

14. A method as claimed in claim 13, including the step of:
varying said second balun relative to said first balun by photon energy stimulation of selected photoresponsive elements between adjacent segments.

15. A method as claimed in claim 13, including the steps of:
providing said matrix with further photoresponsive elements between further electrically conductive segments;
supplying photon energy stimuli to selected ones of said further photoresponsive elements to constitute said first and second antennas from adjacent ones of said further electrically conductive segments; and
connecting said antennas to said baluns.

16. A method as claimed in claim 15, including the step of:
forming feedlines between said baluns and antennas by photon energy stimulation of more of said photoresponsive elements.

17. A method as claimed in claim 1, including the step of:
providing different first and second illumination patterns for said photoresponsive elements to provide selectively said first and second radio frequency interactive configurations.

18. In a radio frequency interactive system variable in response to photon energy stimuli, the improvement comprising in combination:
a matrix of electrically conductive segments and means including photoresponsive elements for selectively separating numerous adjacent segments from each other and for alternatively interconnecting segments with each other in response to photon energy stimuli; and
means for supplying photon energy stimuli to a first array of said photoresponsive elements to provide a first combination of interconnected segments constituting a first radio frequency interactive configuration in said matrix, and for supplying photon energy stimuli to a second array of said photoresponsive elements to provide a second combination of interconnected segments constituting a second radio frequency interactive configuration in said matrix.

19. A system as claimed in claim 18, wherein:
said means for supplying photon energy stimuli include means for supplying said photon energy stimuli to said photoresponsive elements by direct radiation.

20. A system as claimed in claim 1, wherein:
said means for supplying photon energy stimuli include fiber optic lines coupled to said photoresponsive elements.

21. A system as claimed in claim 20, wherein:
parts of said fiber optic lines are extended along said segments.

22. A system as claimed in claim 18, including:
means for providing lumped loading in said matrix, including means for providing and operating selected photoresponsive elements between adjacent segments as radio frequency resistors.

23. A system as claimed in claim 18, wherein:
said matrix is at least two-dimensional.

24. A system as claimed in claim 23, including:
a ground plane for said radio frequency interactive configurations.

25. A system as claimed in claim 18, wherein:
said matrix is three-dimensional.

26. A system as claimed in claim 25, wherein:
said means for supplying photon energy stimuli include means for stimulating photoresponsive elements in different levels of said three-dimentional matrix differently for different radio frequency interactive effects.

27. A system as claimed in claim 25, wherein:
said means for supplying photon energy stimuli include means for forming with selected ones of said photoresponsive elements and with segments connected thereto radio frequency feedlines through said three-dimensional matrix and to at least one of said radio frequency interactive configurations, and means for operating said at least one configuration as a radio frequency antenna.

28. A system as claimed in claim 25, wherein:
at least one of said radio frequency interactive configurations is a radio frequency antenna; and
part of said segments are parasitic elements for said antenna.

29. A system as claimed in claim 18, wherein:
said first radio frequency interactive configuration is a first balun for a first antenna; and
said second radio frequency interactive configuration is a second balun for a second antenna.

30. A system as claimed in claim 29, wherein:
said means for supplying photon energy stimuli include means for varying said second balun relative to said first balun by photon energy stimulation of selected photoresponsive elements between adjacent segments.

31. A system as claimed in claim 29, wherein:

said matrix includes further photoresponsive elements between further electrically conductive segments; and said means for supplying photon energy stimuli include means for supplying photon energy stimuli to selected ones of said further photoresponsive elements to constitute said first and second antennas from adjacent ones of said further electrically conductive segments; and said system includes means for connecting said antennas to said baluns.

32. A system as claimed in claim 31, wherein:

said means for connecting said antennas to said baluns include means for forming feedlines between said baluns and antennas by photon energy stimulation of more of said photoresponsive elements.

33. A system as claimed in claim 18, wherein:

said means for supplying photon energy stimuli include means for providing different first and second illumination patterns for said photoresponsive elements to provide selectively said first and second radio frequency interactive configurations.

* * * * *